United States Patent [19]

Hofmann

[11] 4,343,166

[45] Aug. 10, 1982

[54] CYLINDER LOCK WITH ASSOCIATED FLAT KEY

[75] Inventor: Rudolf Hofmann, Eggenburg, Austria

[73] Assignee: Bauer Kaba AG., Switzerland

[21] Appl. No.: 185,878

[22] Filed: Sep. 9, 1980

[30] Foreign Application Priority Data

Sep. 11, 1979 [AT] Austria ..... 5992/79

[51] Int. Cl.[3] ..... E05B 27/06

[52] U.S. Cl. ..... 70/358; 70/364 A; 70/409

[58] Field of Search ..... 70/358, 409, 405, 406, 70/364 A

[56] References Cited

U.S. PATENT DOCUMENTS 2,733,590 2/1956 Crumb ..... 70/358

3,303,677 2/1967 Bauer ..... 70/358

3,393,542 7/1968 Crepinsek ..... 70/358

3,413,831 12/1968 Crepinsek ..... 70/409

*Primary Examiner*—Robert L. Wolfe

*Attorney, Agent, or Firm*—Roylance, Abrams, Berdo & Farley

[57] ABSTRACT

A lock with a stator and a rotor having a key slot or channel for receiving a flat key has four tumbler rows with pin tumblers, the rows extending in the axial direction of the rotor. The planes containing two of the tumbler rows are inclined by identical angles on opposite sides of the median longitudinal plane of the key and intersect a narrow edge surface of the key adjacent the corners so that the recesses in the key to receive the pin tumblers open on both the narrow side and the flat side key, making it possible to reduce the constructional size of cylinder lock.

8 Claims, 8 Drawing Figures

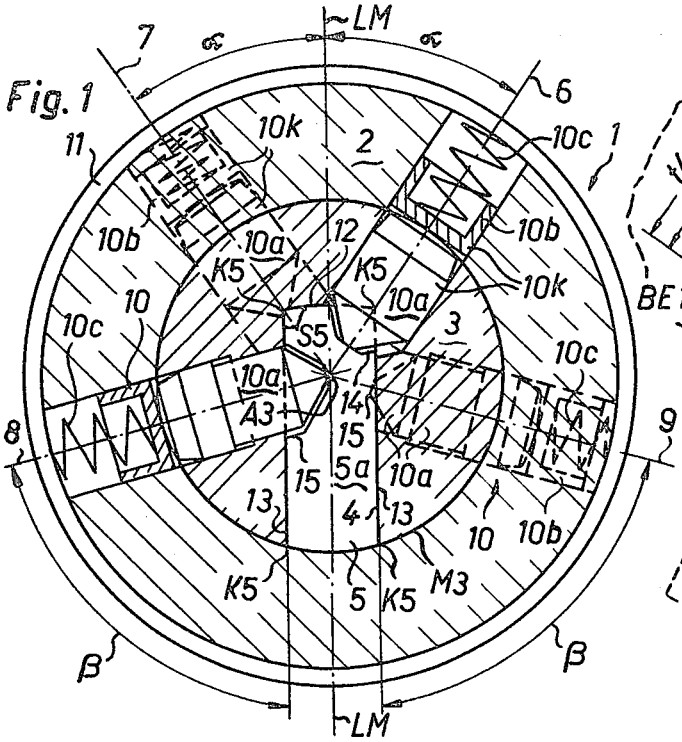
Fig. 1
LM
7
6
11
10k
2
10c
1
10b
10a
12
K5
10
S5
3
A3
14
15
5a
13
4
M3
5
8
9
β
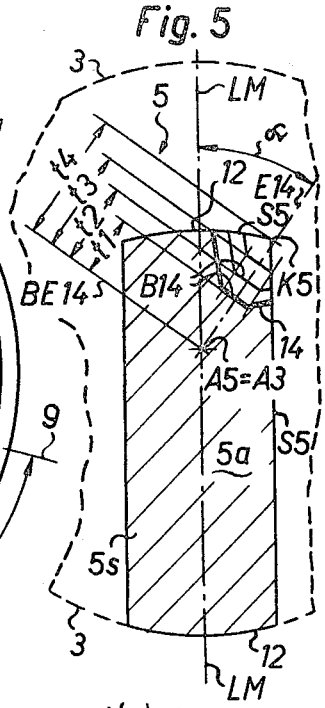
Fig. 5
3
5
LM
12
E14
S5
K5
BE14
B14
14
A5=A3
5a
5s
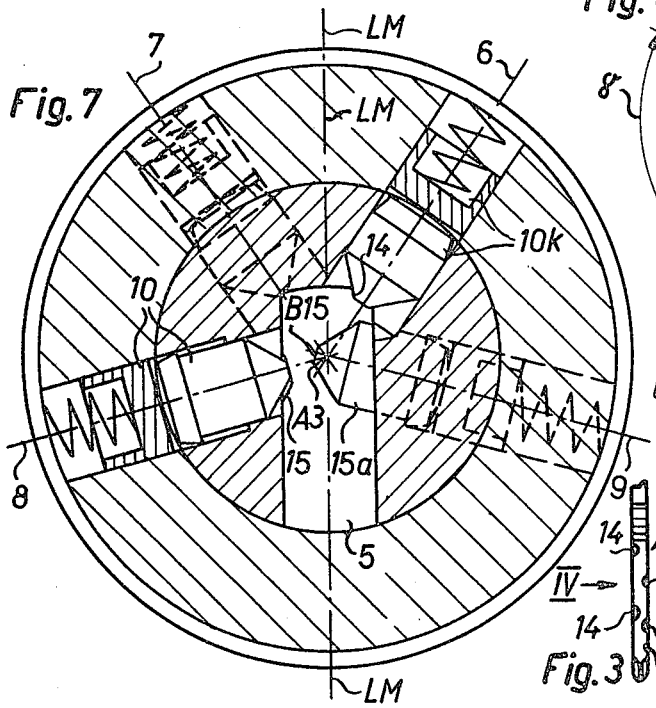
Fig. 7
LM
7
6
10k
14
10
B15
A3
15
15a
5
8
9
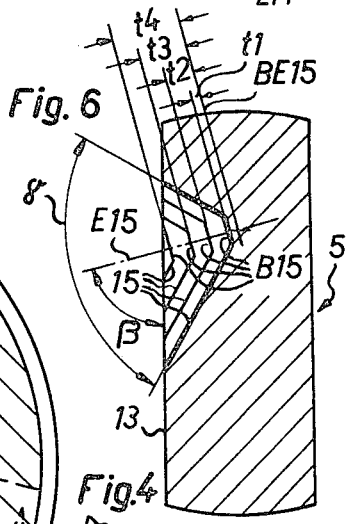
Fig. 6
t4
t3
t2
t1
BE15
8
E15
B15
5
15
β
13
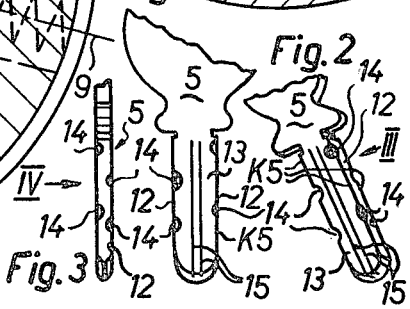
Fig. 4
Fig. 2
Fig. 3
5
14
12
13
K5
15
IV
III

CYLINDER LOCK WITH ASSOCIATED FLAT KEY

This invention relates to a cylinder lock of the type having two-part pin tumblers and to a flat key for use in combination with the lock.

BACKGROUND OF THE INVENTION

A general goal in the field of lock manufacture is to provide improvements in several specific characteristics of the locks and the keys associated therewith, particularly including increasing the level of difficulty of making unauthorized copies of keys and of determining the tumbler arrangement from the key itself; minimizing the overall size of the lock; providing a lock type which has a large number of possible tumbler permutations and, therefore, the possibility for a large number of different key arrangements; providing a lock which is extremely difficult to open without use of a key; and providing a lock which can be manufactured without the expense and difficulty of extremely fine tolerances and without the requirement for overly complex machines or processes for either the lock or the key production. The prior art includes numerous examples of the efforts which have been made in this field in the past.

OS No. 2,546,550 discloses a lock cylinder with a flat key constructed as a pronged bit key in which, in a known manner, closing notches run at right angles to the key shank over the complete narrow side of the key facing away from the key back in such a way that the planar, rectangular notch base faces extend perpendicular to the longitudinal direction of the key shank over the entire narrow side of the key and terminate at the two flat sides therof. In addition, the planar closing notch base faces are inclined at an angle with respect to the key shank median longitudinal plane at an angle, so that the distances of the notch base faces from the key back are greater on one wide side of the key than the corresponding spacing on the other wide side of the key. In addition, the key bow or handle is displaced by a small angle relative to the key shank. The lock slot is inclined by the same angle, so that when the key is inserted, the key bow is in a vertical plane, so that the inclined positions of the key shank and the lock slot are not visible.

The inclined position of the base faces of the recesses, together with the inclined arrangement of the slot in the lock in particular increase manufacturing costs. However, this construction scarcely increases the security against illegal or unauthorized copying of the key.

In another known cylinder lock with a flat key of this general type, shown in German GM No. 7,818,276, each of the two flat sides of the key is associated with a row of tumblers, and the two tumbler planes are inclined in opposite directions by identical angles relative to, in each case, the associated effective lateral surface of the inserted flat key. In addition, in the case of this known cylinder lock two rows of tumblers are associated with one of the two narrow sides of the flat key, and the two tumbler planes are inclined in opposite directions with respect to the median longitudinal plane of the inserted flat key. The two axial planes of the recesses of the two rows of depressions running in the longitudinal direction of the key are inclined in accordance with the slope of the two tumbler planes in opposite directions with respect to the median longitudinal plane of the flat key.

As a result of the large number of rows of tumblers, in the case of this known cylinder lock with a flat key, not only is the security against illegal opening of the lock increased, but particularly due to the inclination of the recesses relative to the key surface, the illegal copying of the key is made more difficult and in addition the number of permutation or combination possibilities available with lock is increased. However, the necessary external diameter of the lock cylinder and, consequently of the complete cylinder lock is still relatively large. Furthermore, the manufacturing tolerances for manufacturing the lock are correspondingly high, so that the security against illegal copying of the key still leaves much to be desired.

DAS No. 1,553,294 describes and shows a tumbler arrangement for the pin tumblers in a rotary cylinder lock, on whose flat key are provided additional recesses for pin tumblers inclined by an angle of 45° relative to the side face of the key, besides the conventionally provided recesses for the perpendicular pin tumblers on the side face of the inserted key. However, the narrow sides of the key are left smooth.

In the case of this lock or the associated key, the manufacturing costs, due to the complicated processing machines and the necessity of maintaining close tolerances, are far too high when compared with the achievable increase in security against copying the key.

BRIEF DESCRIPTION OF THE INVENTION

A primary object of the invention is therefore to obviate these disadvantages and provide a cylinder lock with a flat key which permits a smaller external diameter of the lock cylinder than hitherto, while simultaneously making it even more difficult to illegally copy the associated flat key.

According to the invention, this object is attained by providing a lock wherein the tumbler plane of the tumbler row associated with the narrow side of the flat key intersects the surface of the key shank in the vicinity of one of the two edges of the inserted key bounding the narrow side of the key, and the recesses of the row of recesses on the narrow side of the flat key are located on the key edge and, with respect to the median longitudinal plane of the flat key, are arranged in such a way that, in each case, one recess portion is on the narrow side and the remaining recess portion is on the flat side of the key which forms the key edge with the narrow side.

Briefly described, the invention includes an improved cylinder lock and key combination, the key being of the type having a shank of substantially rectangular cross section with side and edge surfaces, the lock being of the type having a stator portion, a rotor portion received and rotatable in the stator portion, a substantially rectangular, axially extending key slot in said rotor, a plurality of rows of longitudinally spaced, movable two-part pin tumblers received in said rotor and stator, at least two of said rows lying in planes on opposite sides of said key slot and intersecting each of the longer sides of said key slot, at least one additional, third, row of tumblers lying in a plane intersecting a narrow side of said slot and inclined relative to the median plane of the key inserted therein, and wherein the key includes, on each of its flat side surfaces, a row of recesses for receiving tumblers in the rows lying on opposite sides of said slot and a third row of recesses in at least one narrow edge surface thereof, the median axes of said recesses in said third row being inclined at the same angle as said additional row of tumblers, the improvement wherein the plane containing the axes of the recesses in said third row of recesses intersects the narrow edge surface of said key adjacent a corner formed by the junction of a flat side surface and an edge surface so that the recesses in said third row open onto both of said side and edge surfaces.

This not only leads to a smaller diameter of the lock cylinder and consequently a smaller constructional size of the complete cylinder lock, but also makes it more difficult to illegally copy the flat key.

Greater security is also provided against opening the cylinder lock without a key, i.e. with instruments other than the associated flat key, such as used by a burglar in picking the lock. This is due to the provision at at least one point in the axial direction of the cylinder lock rotor, of an arrangement formed by two tumblers in a common tumbler axial plane at right angles to the rotor axis for accomplishing re-locking of the lock, so that if the burglar is able to detach the rotor from its locked position by picking, the relative tumbler pins snap back into radial stator bores, following the rotation thereof by a relatively small rotation angle, which bores are, so to speak, not "genuine", but are in the same tumbler plane, so that the further rotation of the rotor is blocked, i.e. it is locked again. Thus, the rotor would be successively re-locked several times in order to achieve a complete rotor rotation of 360°. In such an opening attempt without using a key, the lock cylinder is automatically damaged and the unsuccessful attempt at entry is immediately apparent.

Further features of the cylinder lock with associated flat key become apparent from the description in conjunction with the accompanying drawings which diagrammatically show embodiments of the cylinder lock and flat key according to the invention, and wherein:

FIG. 1 is transverse sectional view through a cylinder lock with an inserted flat key in accordance with the invention;

FIG. 2 is a partial perspective view of a flat key, shown in and usable in combination with the lock of FIG. 1;

FIG. 3 is an edge elevation of a flat key according to FIG. 2, showing a narrow side of the key in the direction of arrow III of FIG. 2;

FIG. 4 is a side elevation of the flat key of FIG. 3 showing the flat side of the key viewed in the direction of arrow IV of FIG. 3;

FIG. 5 is an enlarged partial view of the blade or shaft of the flat key of FIGS. 1–4 in transverse section, with four depth stages for the edge recess row;

FIG. 6 is an enlarged transverse sectional view of the flat key of FIGS. 1–5 with four depth stages for the side recess row;

Figure 8:
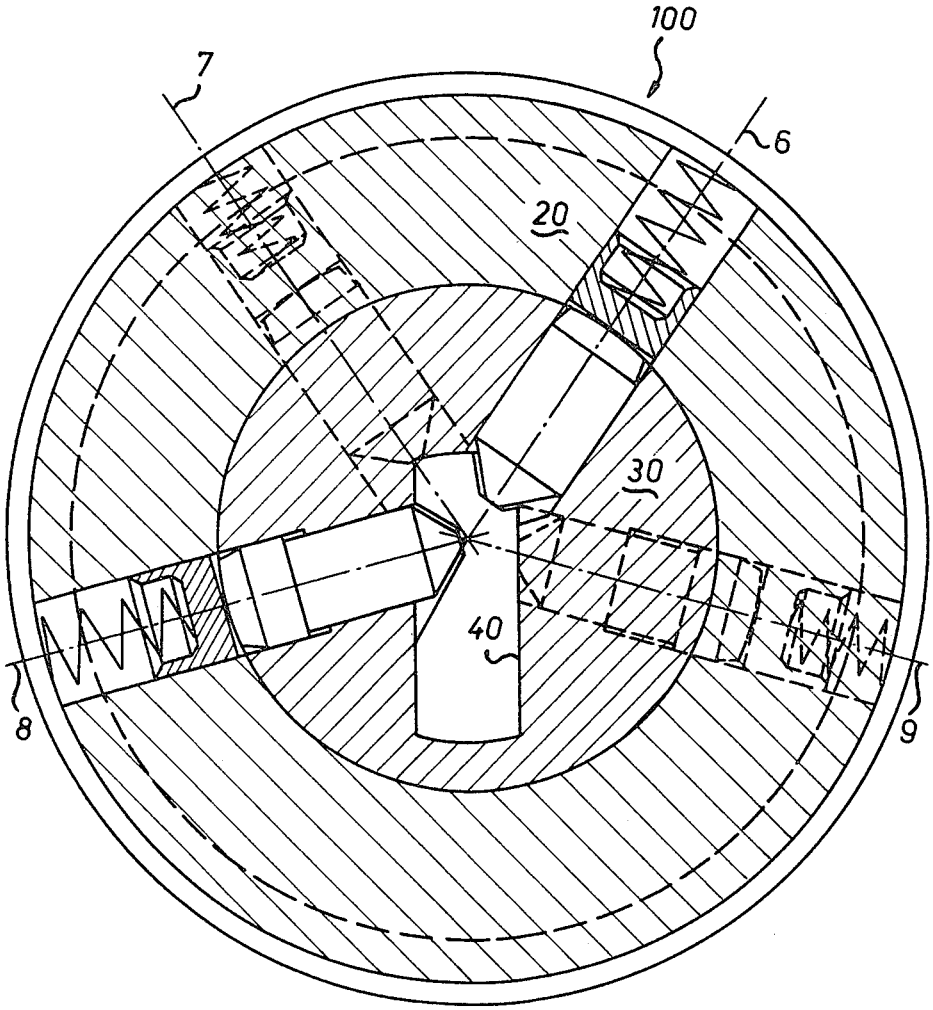

FIG. 7 the cylinder lock with flat key in another cross-section; and

FIG. 8 is a transverse sectional view of a further embodiment of a cylinder lock with inserted flat key, wherein the key channel is completely surrounded by the lock rotor.

In FIG. 1, the cylinder lock 1 comprises a stationary housing 2, which will be referred to as the stator, and a rotatably mounted lock rotor 3 coaxially arranged therein. Rotor 3 has a rectangular key channel 4 which is substantially rectangular in cross section and which points vertically downwards in its normal rotational position for receiving the key. In FIG. 1, the associated flat key 5 is shown inserted. In this case, cylinder lock 1 is provided with four tumbler rows 6, 7, 8 and 9, which rows all extend parallel to the axial direction of rotor 3. The pin tumblers 10 or 10*k*, successively arranged in aligned manner in the four tumbler rows 6–9, are each in two parts and, in each case, comprise the preferably cylindrical tumbler pins 10*a* displaceably mounted in radial bores of rotor 3, as well as the pin-like, so-called "counter-tumblers" 10*b* also being displaceably mounted in corresponding radial bores of stator 2. Tumbler springs 10*c* bear outwardly against the lock sleeve 11 which surrounds and is joined in a fixed but detachable manner with the stator, which springs inwardly loads the counter-tumblers 10*b*.

The two tumbler rows 6 and 7 are operatively associated with the upper narrow side or edge 12 of the key 5, and the two tumbler rows 8 and 9 are associated with, in each case, one of the two flat sides 13 of flat key 5.

The pin tumblers 10*k* of the two tumbler rows 6 and 7 are located in two tumbler planes inclined in opposite directions by identical angles $\alpha$ (which are, in the example shown, 35° in each case) relative to the median longitudinal plane LM of the inserted flat key 5. The tumbler planes extend parallel to the longitudinal axis of the key and intersect the surface S5 of the key shank in the vicinity of, in each case, one of the two linear key edges K5 of the inserted key 5 bounding the narrow side 12 of the shank. On its narrow side 12, flat key 5 is provided with two rows of recesses 14 longitudinally spaced along the shank of the key for receiving the tumbler pins 10*a* of the tumbler rows 6 or 7 associated with the narrow side 12 of the key. Each of the central axes of the recesses 14 of these two rows of recesses is located in a common axial plane (E14 in FIG. 5), the two planes being inclined in opposite directions by identical angles $\alpha$ (of e.g. 35°) relative to the median longitudinal plane LM of flat key 5, these angles corresponding to the inclination of the two tumbler rows 6 and 7. Recesses 14 are arranged in rows on one of the two straight key edges K5 and are so arranged with respect to the median longitudinal plane LM of key 5 that one recess portion is located on narrow edge or side 12 and the remaining recess portion is located on, in each case, one of the two wide or flat sides 13 of key 5 which, together therewith, form the two key edges K5 (cf also FIG. 3).

The tumblers 10 of each of the two side tumbler rows 8 and 9 are located in a tumbler plane, the planes being inclined by identical angles $\beta$ (of e.g. 85°) in opposite directions with respect to the associated effective side face 13 of the inserted flat key 5. The central axes of the recesses 15 in each of the two associated side recess rows are located in a common axial plane inclined by identical angles but in opposite directions relative to the median longitudinal plane LM of flat key 5 in order to conform with the inclination of the two side tumbler rows 9 and 8.

The tumbler planes of the two edge tumbler rows 6 and 7, as well as the tumbler planes of the two side tumbler rows 8 and 9 intersect in FIG. 1 at the rotation axis A3 of lock rotor 3 and, therefore, also in the median longitudinal plane LM of the inserted flat key 5 on a common straight line coinciding with the rotor axis, because the rotor 3 is positioned coaxially to the cylindrical stator 2 of cylinder lock 1.

Key channel 4 of lock rotor 3 is constructed as an enclosed slot or is open towards the surface M3 of cylindrical rotor 3 on its lower narrow side. According to FIG. 1, rotor 3 is in its insertion or removal rotation position for key 5 in which the substantially rectangular key channel 4, corresponding in shape to the key shank cross-section, points vertically downwards.

The central axes of all of tumblers 10K in each edge and side tumbler row lie in an axial (relative to the rotor) plane which also contains axis A3 of the rotor. Each edge tumbler axis also lies in a plane perpendicular to the axis A3, which plane also contains the axis of a tumbler in a side tumbler row. Thus, the tumblers are arranged in pairs, each pair containing one tumbler from an edge row and one from a side row, the axes of the tumblers in each pair being in the same plane. As shown in FIGS. 1 and 7, the tumblers in row 6 are paired with those in row 8, and those in rows 7 and 9 are also paired. However, the common planes of the two tumbler rows 7 and 9 are longitudinally offset, or rearwardly displaced, preferably by half of row separation, relative to the common planes of the two tumbler rows 6 and 8 along the rotor axis A3. Thus, in the cross-section through the cylinder lock 1 according to FIG. 1 it is possible to see an edge tumbler 10*k* of the edge tumbler row 6 and the side tumblers 10 of the side tumbler row 8 located in the same transverse plane, while the two tumblers 10*k* and 10 of tumbler rows 7 or 9 also located in a common plane are located behind the drawing plane in FIG. 1, i.e. are not visible and are therefore indicated in FIG. 1 by dotted lines only.

According to FIG. 2 which is a perspective view, flat key 5, constructed as a turning key with a double recess configuration, the recesses 14 for receiving the tumbler pins 10*a* (cf FIG. 1) following one another in the two edge tumbler rows 6 and 7 are placed on all four key edges K5. However, for reasons of clarity, the so-called "inactive" rows of recesses 14, which have no effect in the insertion rotation position of turning key 5 shown in FIG. 2, and which are also associated with the edge tumbler rows 6 and 7 of cylinder lock 1 and which in FIG. 1 are positioned on the two lower key edges K5 are not shown in FIG. 1. FIG. 2 shows that each of the edge recesses 14 is only partly on the narrow side 12, whereas the remaining recess part is located on the wide or flat side 13 of key 5, i.e., that each recess extends into both of surfaces 12 and 13.

FIG. 2 indicates, by means of two continuous straight lines 15, the recess rows 15 on the flat sides 13 of key 5 for receiving the tumbler pins 10*a* of the two side rows of tumbler 8 and 9 which, due to the construction of flat key as a turning key, are also present in pairs on each of the two flat sides 13. As in the case of the aforementioned edge recesses 14, for reasons of greater clarity, FIG. 2 does not show the "inactive" side recesses or recess rows 15 which, in the case of the insertion position of turning key in FIG. 1 are in each case located on the lower half of the key flat sides 13.

FIG. 3 shows the edge recesses 14 of flat key 5 constructed as a turning key according to FIG. 2, in an edge view of the narrow side 12, while FIG. 4 shows the edge recesses 14 and the locations of two side recess rows 15 in a plan view of a flat side 13 of key 5. It will be understood that the term "turning key" refers to a key which can be inserted in either of two positions angularly separated by 180° with equal effect.

FIG. 5 is a large scale cross-sectional view of the shank 5*s* of flat key 5. Due to the two slightly convex narrow faces 12, cross-section 5*a* of key shank 5*s* is only approximatey rectangular. Four different depths of the edge recesses 14 are designated by t1 to t4 in FIG. 5, t1 representing the greatest depth t of edge recess 4 and key t4 the smaller depth t thereof. Edge recess 14 with the greatest depth t1, also shown in FIG. 1, is stressed in FIG. 5 by thick lines. As edge recess 14 with the minimum depth t4 is located directly on key edge K5 without undercutting surface S5 of key shank 5*s*, so that the tumbler pin 10*a* of the associated edge tumbler 6 is only placed on the key edge (shown in FIG. 1 for the left-inclined edge tumbler row 7) edge recess 14 with minimum depth t here has the depth value t4=0. Rotation axis A5 of flat key 5 inserted in key channel 4 in FIG. 5 and located in its median longitudinal plane LM coincides with rotor axis A3 of cylinder lock 1 (see also FIG. 1), indicated by broken lines in FIG. 5 by means of the only partly shown lock rotor 3. An inclined plane, BE14, which passes through the key rotation axis A5 and is perpendicular to the central axial plane E14 of the edge recess row 14, forms the reference plane for dimensioning the different depths t1 to t4 of the edge recesses 14, said different depth quantities referring to the level plane of the particular one of recess bottoms B14. The central axial plane E14 of edge recess row 14 is at inclined angle $\alpha$ (as in FIG. 1) relative to the median longitudinal plnae LM of flat key 5 corresponding to the slope of the associated edge tumbler row 6 running in the longitudinal direction of the rectangular key.

In a manner similar to FIG. 5 for edge recesses 14, FIG. 6 shows four different depths t1 to t4 for the side recesses 15 of flat key 5 and here, again, the reference plane BE15 which is perpendicular to the central axial plane E15 of the side recess row 15 is "decisive" for dimensioning the depths t1 to t4 of side recesses 15 with reference to the different level planes of recess bottoms B15. The central axial plane E15 of side recess row 15 is inclined by angle $\beta$ relative to the associated effective side face 13 of flat key 5, corresponding to the slope of the associated side tumbler row 8 (cf FIG. 1). The side angle between the two facing lateral sides of the side recesses 15 designated by $\gamma$ in FIG. 6 generally has a value of 90°, corresponding to the cone angle of 90° at the conical apex of the cylindrical tumbler pin 10*a*, this also applying to the edge recesses 14 in FIG. 5.

The side recesses 14 with the smallest depth t4 present in a side recess row are preferably made in the form of a flat insertion groove milled in the longitudinal direction of the key and whose profile is adapted to the slightly flattened cone apex of the tumbler pins (10*a* in FIG. 1). Quite apart from the ease of manufacture, this has the advanatage of reduced wear, because the tumbler pins slide on the bottom of the insertion grooves inclined in accordance with the slope of the side tumbler row accompanied by surface contact when inserting and removing the flat key, instead of point contact on the planar key side face.

This measure also relieves the tumbler springs (10*c* in FIG. 1), which further reduces wear to the key and tumbler pin. In addition, undesired inclined forces are avoided on the bore hold of the radial rotor bores in which the tumbler pins are mounted in axially displaceable manner. This also prevents self-rotation of the tumbler pins.

FIG. 7 shows cylinder lock 1 with inserted flat key 5 in a cross-section differing from that of FIG. 1. It is once again possible to see an edge tumbler 10*k* of the right-hand edge tumbler row 6 and a side tumbler 10 of the left-hand side tumbler row 8, both of whose central axes are in a common transverse plane perpendicular to rotor axis A3. However, the associated key recesses 14 and 15 have depths t which differ from the corresponding recesses 14 and 15 in FIG. 1. Whereas in FIG. 1 the right-hand edge recess 14 and the left-hand side recess 15 of flat key 5 have in each case the maximum depth t1 (cf also FIGS. 5 and 6) in FIG. 7 the right-hand edge recess 14 only has a depth t3 (cf FIG. 5) and the left-hand side recess 15 has the minimum depth t4 (cf FIG. 6). A particular deep, right-hand side recess 14*a* whose bottom B15, unlike in FIG. 6, is located beyond the medium longitudinal LM of flat key 5, shows the possibility of using such extremely deep recesses for the key side face 13 with otherwise constant key dimensions.

FIG. 8 shows another embodiment which includes a cylinder lock 100 in which the key channel 40 is not slot-like in the same fashion as key channel 4 of FIG. 1, i.e. open towards the cylindrical surface of rotor 3. Instead, it is constructed in window-like manner, i.e. as a "penetrated" channel completely surrounded by rotor 30. FIG. 8 shows that the tumbler system for cylinder lock 1 shown in FIGS. 1 to 7 with the two edge tumbler rows 6 and 7, together with the two side tumbler rows 8 and 9, can also be realized with the more rigid and therefore sturdier rotor construction with a window-like key channel 40 and the external diameter of the stator 20 of cylinder lock 100, i.e. the so-called "cylinder diameter" need only be increased by a few millimeters for space reasons.

The key recesses can be manufactured very rationally and very precisely by the continuous path milling process can also be used to mill lengthened recesses in the key shank in the longitudinal direction of the key, so that the tumbler centers of these recesses are concealed (these can be side and/or edge recesses), i.e. the burglar-proof effect is increased, as described in Austrian Pat. No. 343,506.

It is advantageous to "lengthen" the recesses on only one side from the tumbler center towards the key milling lozenge or diamond in the longitudinal direction of the key and consequently to allow the recess flank, located on the side of the recesses facing the key tip and serving as a lifting slide path for the tumbler pins, to act as a supporting flank for limiting the longitudinal pulling of the inserted key which has already been turned somewhat from its insertion or removal rotation position. This prevents tumbler pins from engaging in "not genuine" stator bores during the further rotation of the rotor if, after the start of turning the key the latter is pulled during its further rotation, i.e. prematurely. This so-called "hanging or sticking" would block the further rotation of the key and rotor, as described in Austrian Pat. No. 345,692.

The side tumbler rows can be in tumbler planes located perpendicularly to the key side face instead of being inclined to the associated effective side face of the inserted flat key.

The invention is not limited to the embodiments illustrated by means of the drawings and constructional details can be modified within the scope of the invention as defined in the appended claims.

What is claimed is:

1. An improved clyinder lock and key combination, the key being of the type having a shank of substantially rectangular cross section with sides and edge surfaces, the lock being of the type having a stator portion, a rotor portion received and rotatable in the stator portion, a substantially rectangular, axially extending key slot in said rotor, a plurality of rows of longitudinally spaced, radially movable two-part pin tumblers received in said rotor and stator, at least two of said rows lying in planes on opposite sides of said key slot and intersecting each of the longer sides of said key slot, at least one additional third, row of tumblers lying in a plane intersecting a narrow side of said slot and inclined relative to the median plane of the key inserted therein, and wherein the key includes, on each of its flat side surfaces, a row of recesses for receiving tumblers in the rows lying on opposite sides of said slot and a third row of recesses in at least one narrow edge surface thereof the median axes of said recesses in said third row being inclined at the same angle as said additional row of tumblers, the improvement wherein the plane containing the axes of the recesses in said third row of recesses intersects the narrow edge surface of said key adjacent a corner formed by the junction of a flat side surface and an edge surface so that the recesses in said third row open onto both of said side and edge surfaces.

2. A lock and key according to claim 1 and further including a fourth row of tumblers in said lock, said fourth row lying in a plane inclined on the opposite side of the median plane from said third row, said fourth row extending into said slot at a corner thereof, said key further including a fourth row of recesses at a corner thereof, the plane containing the axes of the recesses in said third row intersecting said same narrow edge surface adjacent the corner formed by the junction of said edge surface and the opposite flat side so that said recesses open onto both of said edge and side surfaces forming the corner.

3. A lock and key according to claim 2 wherein the planes containing said third and fourth rows of tumblers and recesses are inclined at equal angles on opposite sides of said median plane and intersect said median plane along the same line.

4. A lock and key according to claim 3 wherein the axes of said rows of tumblers intersecting said flat sides of said key, and the axes of the recesses in said flat sides, lie in planes inclined relating to said median plane, the angles of inclination being equal to each other and different from the angles of inclination of the planes containing said third and fourth rows and recesses, and wherein said planes intersect along the same line as said third and fourth planes.

5. A lock and key according to claim 1 wherein said key slot opens on the outer surface of said rotor.

6. A lock and key according to claim 1 wherein said key slot lies completely within said rotor and opens at one end thereof.

7. A lock and key according to claim 1 wherein the planes containing said rows of tumblers and recesses are aligned with each other and are perpendicular to the flat side of said key and slot.

8. A lock and key according to claim 1 wherein said key is formed as a turning key and is provided with recesses symmetrically arranged on both narrow edges and flat sides.

* * * * *